United States Patent [19]

Bigo et al.

[11] Patent Number: 4,898,076

[45] Date of Patent: Feb. 6, 1990

[54] MULTIPLE CYLINDER-CAPACITY PRESSURIZED FLUID (MOTOR OR PUMP) MECHANISM

[75] Inventors: Louis Bigo, Compiegne; Bernard Allart, Crepy-en-Valois, both of France

[73] Assignee: 501 Societe Anonyme: Poclain Huydraulics, B.P. 12, Verb Erie, France

[21] Appl. No.: 155,362

[22] Filed: Feb. 12, 1988

[30] Foreign Application Priority Data

Feb. 25, 1987 [FR] France ..... 87 02509

[51] Int. Cl.[4] ..... F01B 13/06

[52] U.S. Cl. ..... 91/491

[58] Field of Search ..... 91/491, 492, 497, 472

[56] References Cited

U.S. PATENT DOCUMENTS 3,760,691 9/1973 Kress et al. ..... 91/472
3,808,951 5/1974 Martin ..... 91/492
4,398,450 8/1983 Louhio ..... 91/477
4,404,896 9/1983 Allart et al. ..... 91/491
4,724,742 2/1988 Bigo et al. ..... 91/497

FOREIGN PATENT DOCUMENTS 2127268 10/1972 France .
2481755 11/1981 France .
2055987 3/1981 United Kingdom .

*Primary Examiner*—Michael Koczo
*Attorney, Agent, or Firm*—Poms, Smith, Lande & Rose

[57] ABSTRACT

The invention relates to a pressurized fluid mechanism comprising a plurality of pistons (14) and a plurality of different cylinder capacities. A particular cylinder capacity is selected by means of two identical slide valves (17, 18) which serve selectively to neutralize either a first overall cylinder capacity (45*a*) or a second overall cylinder capacity (45*c*), or both or neither of said first and second cylinder capacities. One application of the invention is to providing an efficient and compact motor which is cheap to produce.

14 Claims, 7 Drawing Sheets

MULTIPLE CYLINDER-CAPACITY PRESSURIZED FLUID (MOTOR OR PUMP) MECHANISM

Hydraulic motor or pump mechanisms are already known for obtaining a plurality (at least two) distinct operating cylinder capacities.

BACKGROUND OF THE INVENTION

Thus, French patent application No. 2 481 755 describes and shows a pressurized fluid (motor or pump) mechanism, e.g. a hydraulic motor having at least two selectable distinct non-zero cylinder capacities, the mechanism being constituted by: at least one first external connector for connection to a source of fluid under pressure, and at least one second external connector for connection to a fluid exhaust; at least one cam whose profile corresponds to a plurality of successive undulations, said undulations being divided at least into first and second distinct groups of undulations with each undulation comprising a first slope and a second slope; a cylinder block mounted to rotate relative to said cam about an axis of rotation and which includes a plurality of cylinders disposed substantially radially relative to said axis of rotation; each cylinder having at least one piston slidably mounted therein and suitable for bearing against the cam and delimiting, within said cylinder, a working chamber which is connected to a communication face of the cylinder block; a plurality of cylinder ducts each connecting one of the working chambers to said communication face of the cylinder block; a fluid distribution face constrained to rotate with the cam, said face permanently bearing against the communication face of the cylinder block and having first and second fluid distribution ducts opening out therein and corresponding to said first and second slopes of each of the undulations, said distribution ducts being suitable for being put into communication, during relative rotation of the cylinder block and the cam, with the cylinder ducts of the various cylinders; and cylinder capacity selection means comprising at least a first cylinder-capacity selection slide valve disposed between said first and second external connectors and the first and/or second distribution ducts corresponding to the undulations of the second group of undulations; said first cylinder capacity selection slide valve having a first position suitable for corresponding: (a) to the first distribution ducts corresponding to the undulations of both groups of undulations being put into communication with the first external connector, and (b) to the second distribution ducts corresponding to the undulations of both groups of undulations being put into communication with the second external connector, and having a second position suitable for corresponding: (a) to the first distribution ducts corresponding to the undulations of the first group of undulations being put into communication with first external connector, (b) to the second distribution ducts corresponding to the undulations of said first group of undulations being put into communication with the second external connector, and (c) to the first distribution ducts corresponding to the undulations of the second group of undulations being permanently isolated from the first external connector and/or to the second distribution ducts corresponding to the undulations of said second group of undulations being permanently isolated from the second external connector.

In such mechanisms where the cylinder capacity is selected by deciding to connect the normal feed system to the cylinders which at each instant are disposed facing the cams either of both groups of cams or of one of the groups only, it is also known to provide the pistons facing respective ones of the groups of cams with different strokes. French patent No. 2 127 268 shows a mechanism of this type.

All of these mechanisms operate well, but their particular design generally makes them complex and expensive to manufacture.

Preferred embodiments of the invention remedy these drawbacks of prior mechanisms by providing a structure which is simpler and suitable for providing the cylinder capacity selections desired by a user, in particular for providing a selection between three different non-zero cylinder capacities and a zero cylinder capacity, without requiring expensive machining.

SUMMARY OF THE INVENTION

To this end, in a mechanism analogous to that defined above, the cylinder capacity selection means in accordance with the present invention includes a second cylinder-capacity selection slide valve which also has two positions and which is disposed between the first and second external connectors and the first and/or second distribution ducts corresponding to the undulations of the first group of undulations, said second cylinder-capacity selection slide valve having a first position which corresponds (a) to the first distribution ducts corresponding to the undulations of the first group of undulations being put into communication with first external connector, (b) to the second distribution ducts corresponding to the undulations of said first group of undulations being put into communication with the second external connector, and having a second position which corresponds to the first distribution ducts corresponding to the undulations of the first group of undulations being permanently isolated from the first external connector and/or to the second distribution ducts corresponding to the undulations of said first group of undulations being permanently isolated from the second external connector.

Another overall definition of the invention, equivalent to that given above, consists in specifying that the invention provides a pressurized fluid (motor or pump) mechanism, e.g. a hydraulic motor having at least two selectable distinct non-zero cylinder capacities, the mechanisms being constituted by: at least one first external connector for connection to a source of fluid under pressure, and at least one second external connector for connection to a fluid exhaust; at least one cam whose profile corresponds to a plurality of successive undulations, said undulations being divided at least into first and second distinct groups of undulations with each undulation comprising a first slope and a second slope; a cylinder block mounted to rotate relative to said cam about an axis of rotation and which includes a plurality of cylinders disposed substantially radially relative to said axis of rotation; each cylinder having at least one piston slidably mounted therein and suitable for bearing against the cam and delimiting, within said cylinder, a working chamber which is connected to a communication face of the cylinder block; a plurality of cylinder ducts each connecting one of the working chambers to said communication face of the cylinder block; a fluid distribution face constrained to rotate with the cam, said face permanently bearing against the communication face of the cylinder block and having first and second fluid distribution orifices opening out therein and corresponding to said first and second slopes of each of the undulations, said distribution ducts being suitable for being put into communication, during relative rotation of the cylinder block and the cam, with the cylinder ducts of the various cylinders; a first cylinder-capacity selection slide valve disposed between said first and second external connectors and the first and/or second distribution ducts corresponding to the undulations of the second group of undulations; a second cylinder-capacity selection slide valve disposed between said first and second external connectors and the first and/or second distribution ducts corresponding to the undulations of the first group of undulations; each of said first and second cylinder-capacity selection slide valves having two particular positions, which together correspond: (A) with the first cylinder-capacity selection slide valve and the second cylinder-capacity selection slide valve both being in their respective first positions, (a) to the first distribution ducts corresponding to the undulations of both groups of undulations being put into communication with the first external connector, and (b) to the second distribution ducts corresponding to the undulations in both groups of undulations being put into communication with the second external connector; (B) with the first cylinder-capacity selection slide valve being in its second position and the first cylinder-capacity selection slide valve being in its first position, (a) to the first distribution ducts corresponding to the undulations of the first group of undulations being put into communication with the first external connector, (b) to the second distribution ducts corresponding to the undulations of said first group of undulations being put into communication with the second external connector, and (c) to the first distribution ducts corresponding to the undulations of the second group of undulations being permanently isolated from the first external connector and/or to the second distribution ducts corresponding to the undulations of said second group of undulations being permanently isolated from the second external connector; (C) with the first cylinder-capacity selection slide valve in its first position and the second cylinder-capacity selection slide valve being in its second position, (a) to the first distribution ducts corresponding to the undulations of the second group of undulations being put into communication with the first external connector, (b) to the second distribution ducts corresponding to the undulations of the second group of undulations being put into communication with the second external connector, and (c) to the first distribution ducts corresponding to the undulations of the first group of undulations being permanently isolated from the first external connector and/or to the second distribution ducts corresponding to undulations of the first group of undulations being permanently isolated from the second external connector; and (D) with the first cylinder-capacity selection slide valve in its second position and the second cylinder-capacity selection slide valve in its second position, to the first distribution ducts corresponding to undulations of the first group of undulations being permanently isolated from the first external connector and to the second distribution ducts corresponding to the undulations of the second group of undulations being permanently isolated from the second external connector and/or to the second distribution ducts corresponding to the undulations of the first group of undulations being permanently isolated from the second external connector and to the first distribution ducts corresponding to the undulations to the second group of undulations being permanently isolated from the first external connector, and/or to the first distribution ducts corresponding to the undulations of both groups of undulations being permanently isolated from the first external connector, and/or to the second distribution ducts corresponding to the undulations of both groups of undulations being permanently isolated from the second external connector.

In addition, the following advantageous dispositions are preferably adopted:

(a) three distinct distribution manifolds are provided linked to the cam, with the first distribution ducts corresponding to the undulations of the first group of the undulations opening out into a first one of said distribution manifolds, with the first distribution ducts corresponding to the undulations of the second group of undulations opening out into a second of said distribution manifolds, and with the second distribution ducts corresponding to the undulations of both the first and the second groups of undulations opening out into the third of said distribution manifolds; (b) each of the first and second cylinder-capacity selection slide valves is movably mounted in a corresponding bore provided in a valve body with each bore having a corresponding first, second, and third transit chambers provided in said body and opening out into said bore; (c) with each slide valve slide member has a communication chamber formed therein and opening out peripherally; (d) the following permanent connections are provided: the first transit chamber of each slide valve is connected to the first external connector; the second transit chamber of the first slide valve is connected to the second distribution manifold; the second transit chamber of the second slide valve is connected to the first distribution manifold; and the third transit chambers of both slide valves are connected to the second distribution manifold and to the second external connector; and (e) the following connections are provided in the first and/or second positions of each of the cylinder-capacity selection slide valves: in the first position of the first slide valve, the first and second transit chambers of said first slide valve are put into communication via the communication chamber of said first slide valve; in the second position of the first slide valve, the second and third transit chambers of said first slide valve are put into communication via the communication chamber of said first slide valve; in the first position of said second slide valve, the first and second transit chambers of said second slide valve are put into communication via the communication chamber of said second slide valve; and in the second position of the second slide valve, the second and third transit chambers of the second slide valve are put into communication via the communication chamber of said second slide valve;

the cam is an integral part of a housing which itself constitutes the slide valve body in which the bores of the first and second cylinder-capacity selection slide valves are formed;

the second cylinder-capacity selection slide valve is identical to the first cylinder-capacity selection slide valve;

each slide valve is mounted to slide in translation within the corresponding bore;

each bore comprises at least one end and provides a chamber between said end and one of the ends of the corresponding slide of the cylinder-capacity selection slide valve, said chambers receiving fluid under pressure to adjust the position of said cylinder-capacity selection slide valve; and the cam has an even number of undulations, with the undulations of the first group of undulations each having a first amplitude which corresponds to a first stroke of a piston bearing against said undulation during relative rotation between the cylinder block and the cam, and with the undulations of the second group of undulations each having a second amplitude corresponding to a second stroke of a piston bearing against said second undulation during relative rotation of the cylinder block relative to the cam, with said first and second strokes having different values, and with the various undulations following one another in such a manner that each of the undulations of the second group of undulations lies between two undulations of the first group of undulations.

The advantages of the newly proposed dispositions lie in the great ease with which multiple cylinder-capacity mechanisms can be made with a much smaller amount of machining being required, and consequently at lower cost, while naturally retaining the desired functional characteristics.

BRIEF DESCRIPTION OF THE DRAWINGS

An embodiment of the invention is described by way of example with reference to the accompanying drawings, in which:

FIGS. 6, 7, and 8 are axial sections analogous to FIG. 1, but corresponding to second, third, and fourth configurations respectively of the motor's cylinder capacity selection slide valves.

Figure 1:
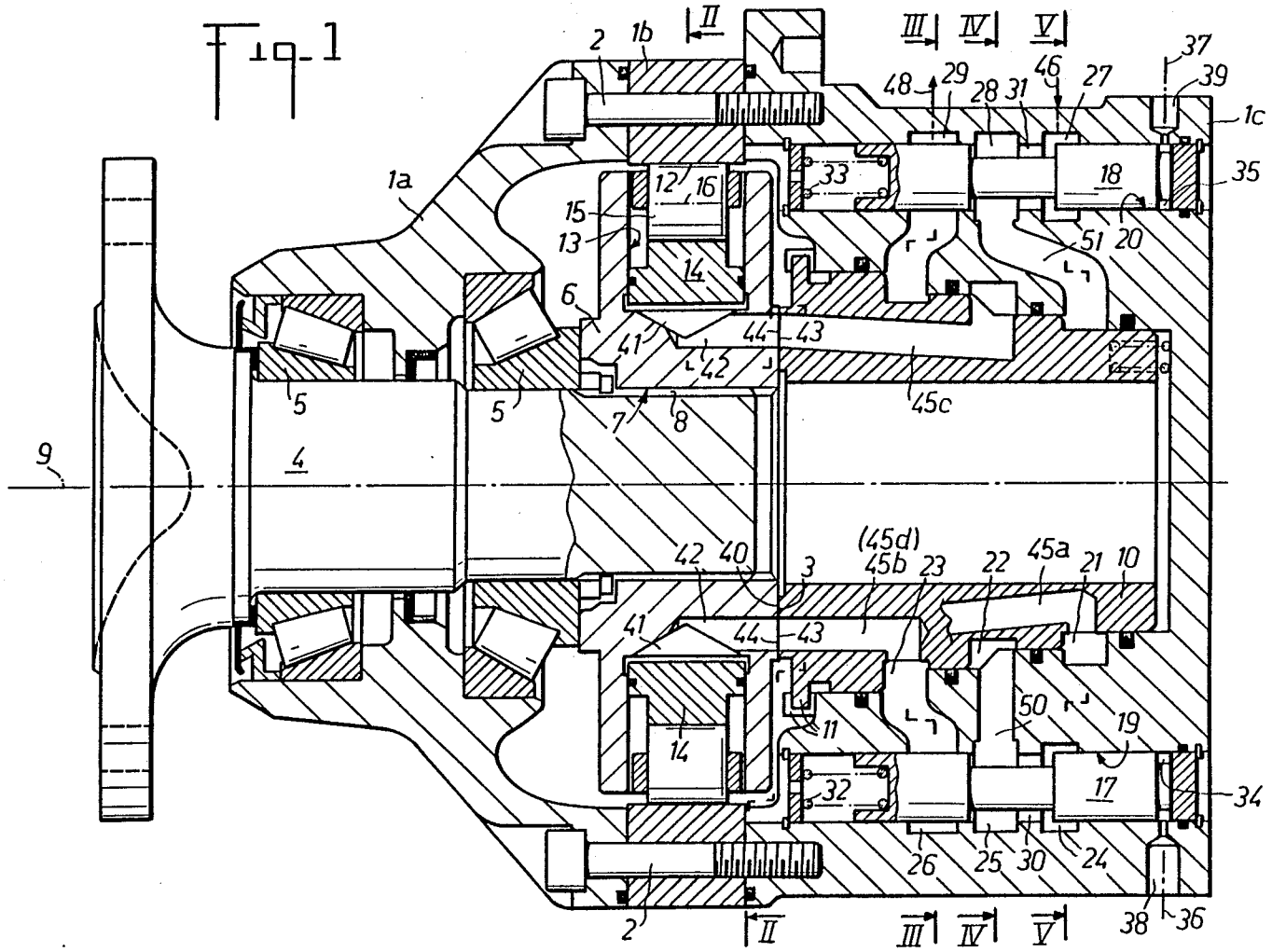
FIG. 1 is an axial section on line I—I of FIG. 3 through a hydraulic motor in accordance with the invention, showing the cylinder-capacity slide valves of the motor in a first configuration.
Figure 2:
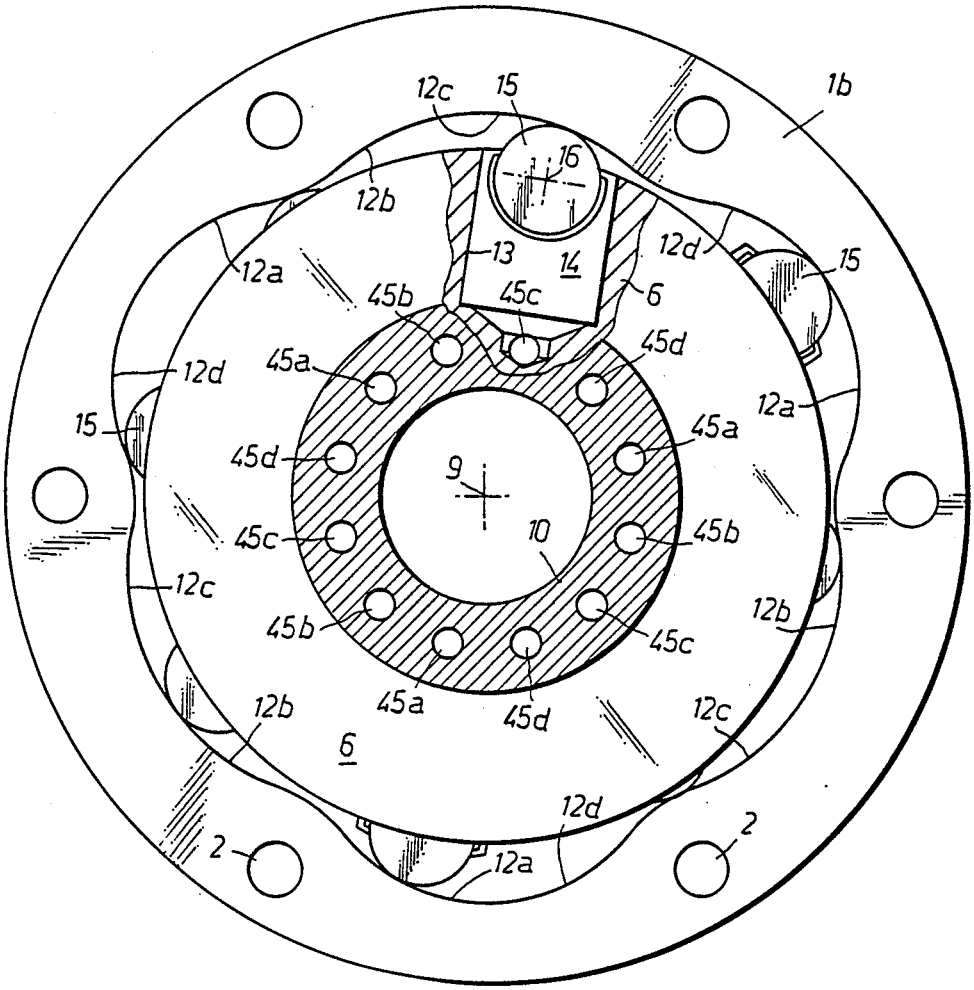
FIG. 2 is a cross-section on line II—II of FIG. 1.
Figure 3:
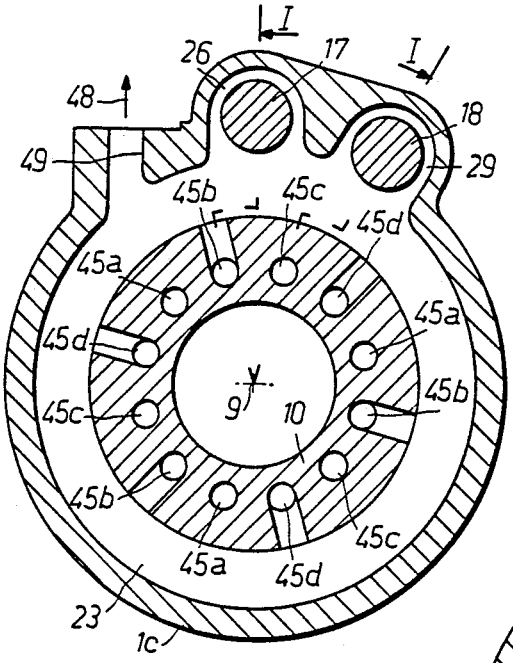
FIGS. 3, 4, and 5 are cross-sections on lines III—III, IV—IV, and V—V, respectively of FIG. 1.
Figure 4:
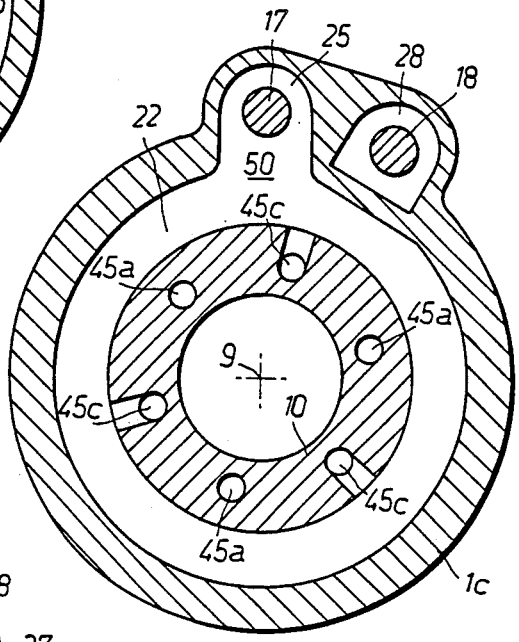
Figure 5:
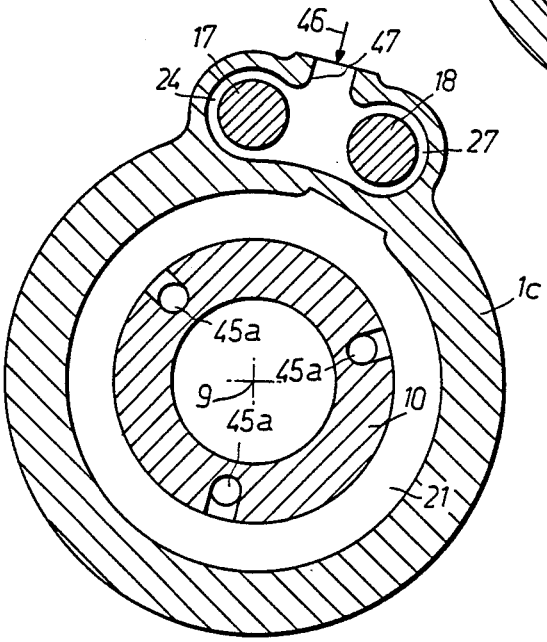

It will be understood that the embodiment described and shown in the drawings is given purely by way of example and is not limiting on the scope of the invention.

MORE DETAILED DESCRIPTION

The motor shown in FIGS. 1 to 5 comprises:

a three-part casing comprising portions 1*a*, 1*b*, and 1*c* which are assembled together by screws 2;

an outlet shaft 4 mounted in two roller bearings 5 to rotate relative to the casing about an axis 9;

a cylinder block 6 which is mounted at one end of the outlet shaft 4 inside the casing, and which is provided with fluting 7 engaging in complementary fluting 8 on said outlet shaft, thereby constraining the cylinder block and the shaft to rotate together, and also mounting the cylinder block to rotate about the axis 9;

a distributor valve 10 which may oscillate very slightly parallel to the axis 9, and which is constrained from rotating with casing portion 1*c* by means of interfitting notches and tabs 11 provided on these two parts;

a cam 12 which in this case has six undulations that follow one another smoothly, said undulations being divided into two groups of undulations 12*a*–12*d* and 12*c*–12*b*, with each undulation 12*a*–12*d* of the first group being constituted by a first slope 12*a* and a second slope 12*d* and being interposed between two undulations of the second group, and with each undulation in the second group being itself constituted by a first slope 12*c* and a second slope 12*b;* a plurality of cylinders 13 which are provided in the cylinder block 6 and which are disposed radially relative to the axis 9, and which are regularly spaced angularly from one another;

a plurality of pistons 14, with one piston being slidably mounted in each cylinder, and with each piston carrying a roller 15 whose axis 16 is parallel to the axis 9 and which is suitable for being pressed against the various undulations of the cam 12; and two cylinder-capacity selection slide valves, namely a first slide valve 17 and a second slide valve 18, said slide valves being cylindrical, identical, and slidably mounted in respective bores 19 and 20 provided in casing portion 1*c*.

Figure 6:
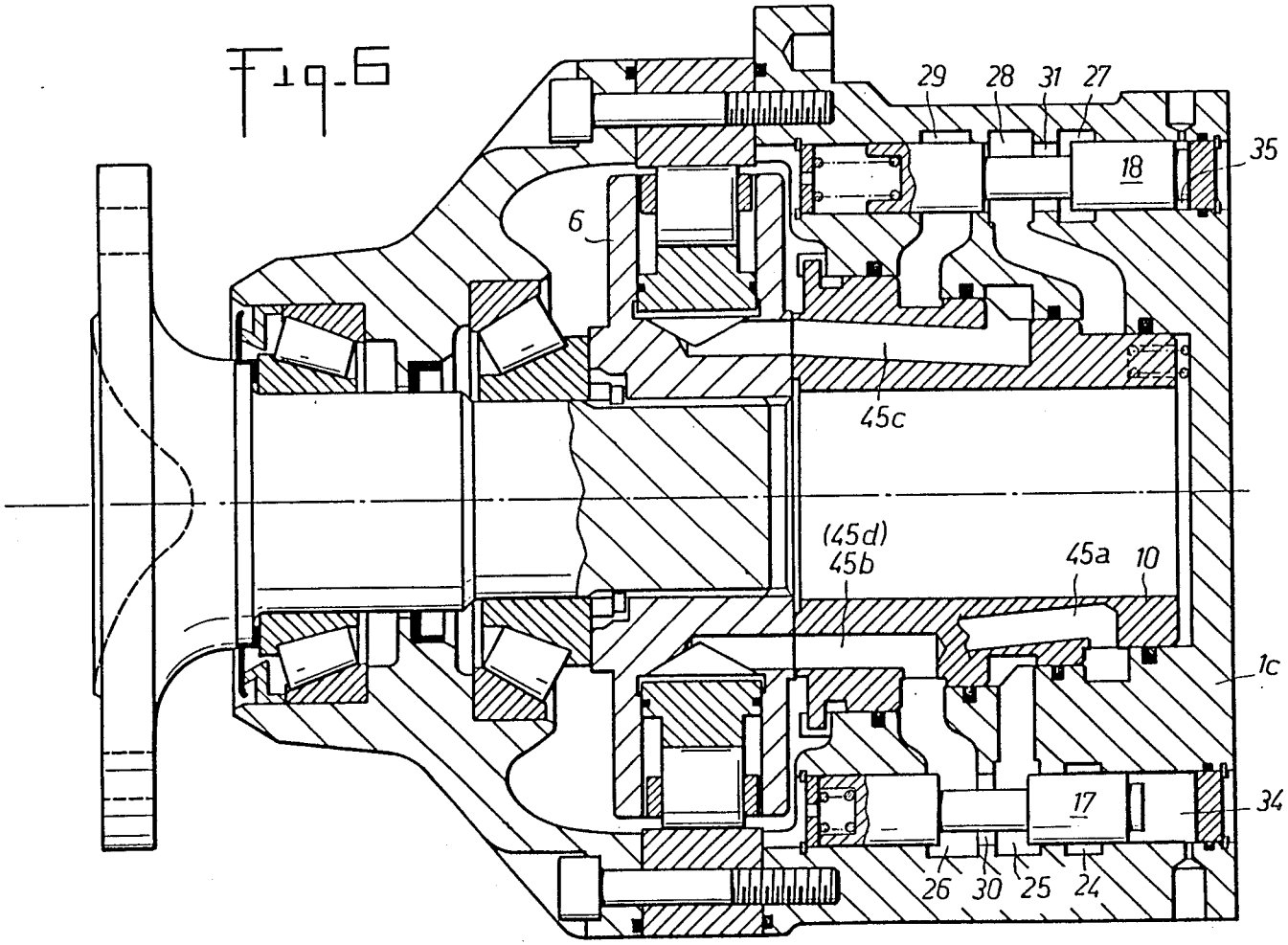
Figure 7:
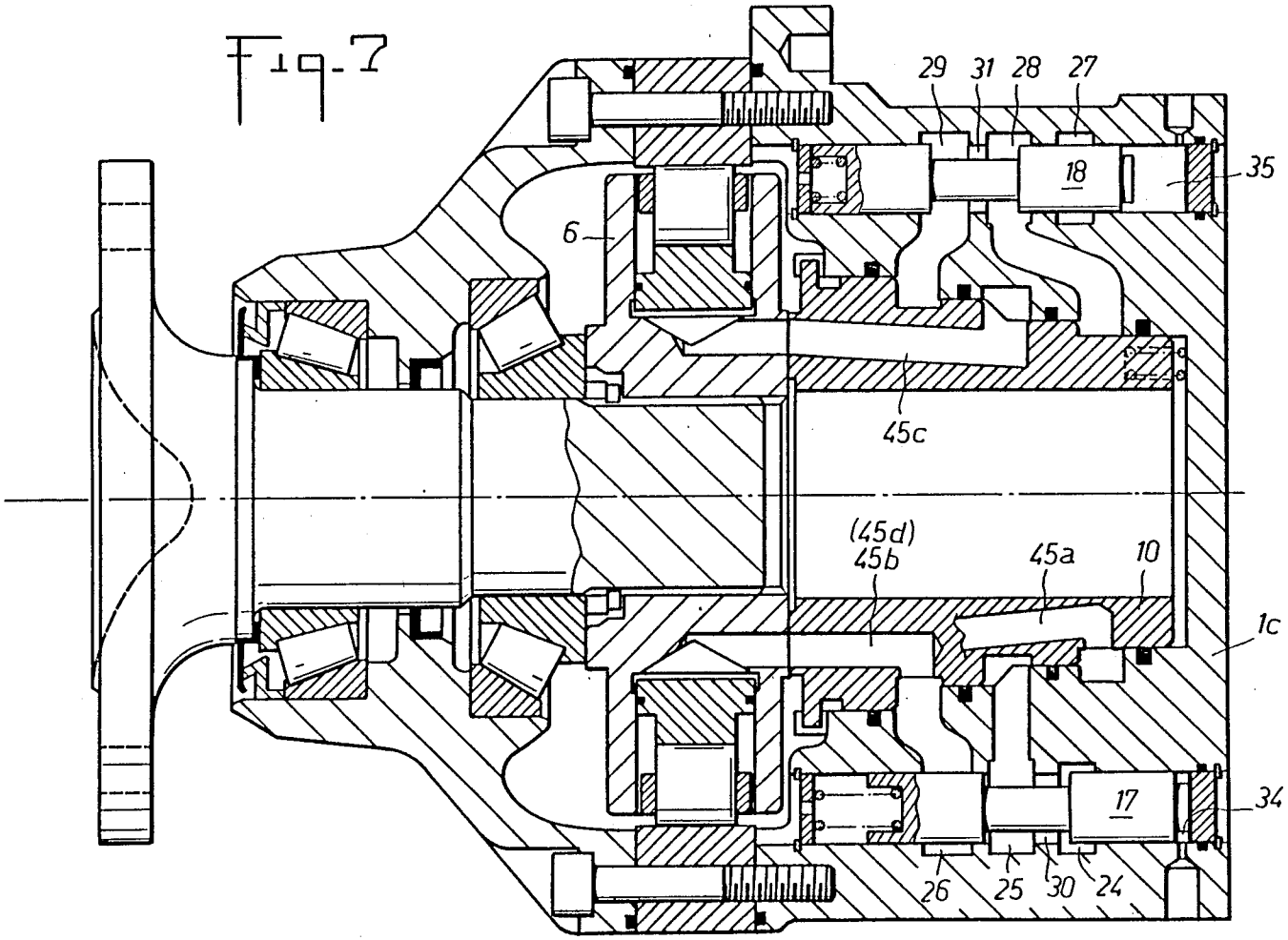
Figure 1:
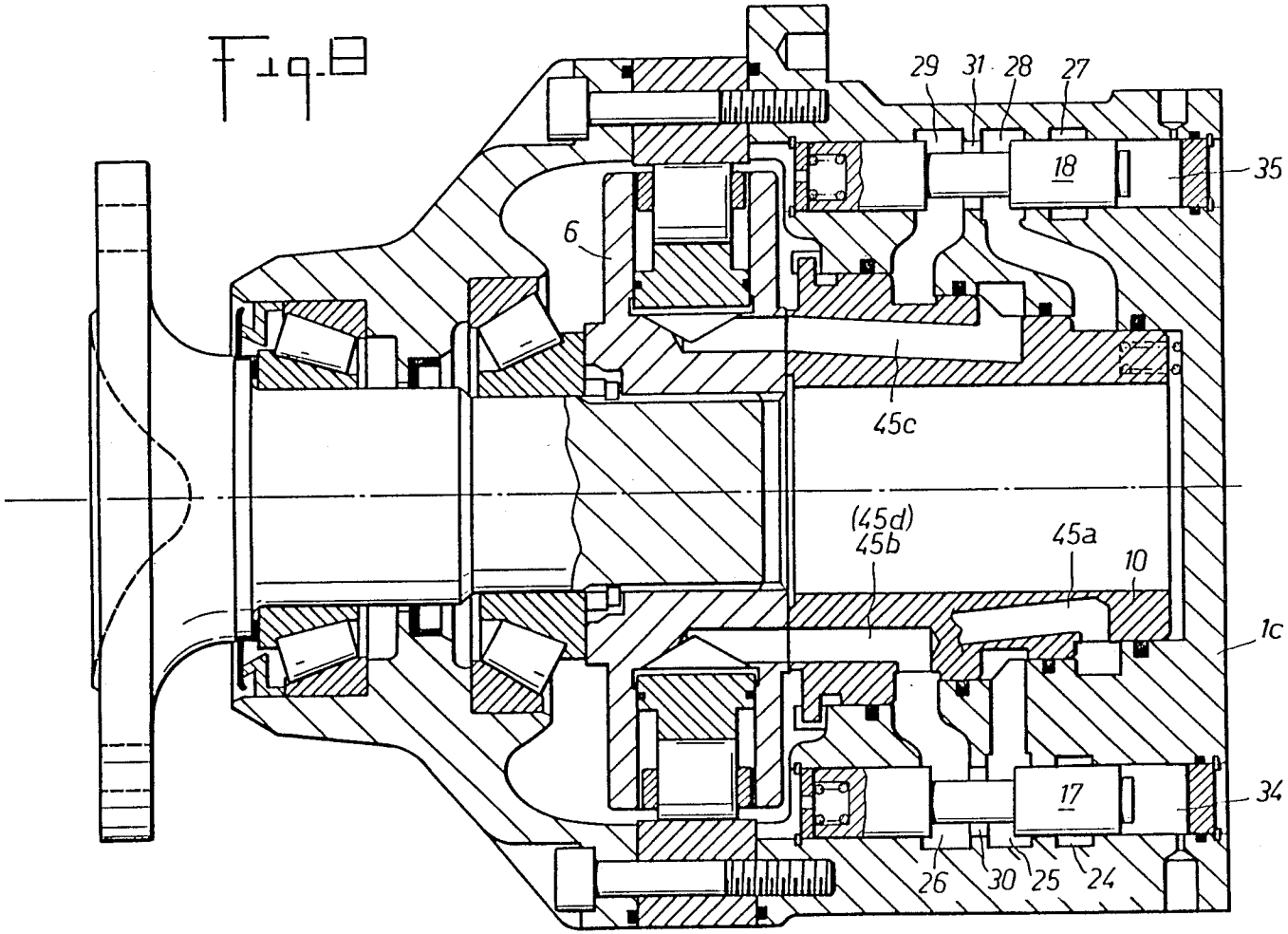

The following features may be noted:

first, second, and third distribution manifolds 21, 22, and 23 respectively are provided between the distributor valve 10 and casing portion 1*c*, said manifolds being in the form of annular grooves;

first, second, and third transit chambers 24, 25, and 26 respectively, all corresponding to the first cylinder-capacity selection slide valve 17, are formed in casing portion 1*c* in the form of respective annular grooves opening out into the bore 19 separately from one another;

first, second, and third transit chambers 27, 28, and 29 respectively, all corresponding to the second cylinder-capacity selection slide valve 18, are formed in casing portion 1*c* in the form of respective annular grooves opening out into the bore 20 separately from one another;

each cylinder-capacity selection slide valve comprises a communication chamber constituted by an intermediate annular groove and suitable, as a function of the position of the corresponding slide, to put either the first and second corresponding transit chambers into communication or else to put the second and third transit chambers into communication, with the first cylinder-capacity selection slide valve 17 having a communication chamber 30 and the second cylinder-capacity selection slide valve 18 having a communication chamber 31;

each of the cylinder-capacity selection slide valves 17 and 18 is suitable for being placed in a first position (in which the corresponding first and second transit chambers 24 and 25 or 27 and 28 are put into communication) under the effect of a spring 32 or 33, or else in a second position (putting the corresponding second and third transit chambers 25 and 26 or 28 and 29 into communication) under the predominant, spring-opposing effect of the pressure of a control fluid contained in a control chamber 34 or 35 delimited at one end of the corresponding slide valve;

said control chambers 34 and 35 are also connected via respective connectors 38 and 39 to ducts 36 and 37;

the distributor valve 10 has a plane transverse face 40 which is substantially perpendicular to the axis 9 and which is slidably pressed against a plane transverse face 3 of the cylinder block 6;

the working chambers 41 delimited by the pistons 14 inside the cylinders 13 communicate with the plane face 3 of the cylinder block via cylinder ducts 42 which open out in said plane face 3 via orifices 43 which are regularly distributed around a circle centered on the axis 9;

the distributor valve 10 has fluid distribution ducts corresponding to the cam slopes, said ducts opening out into the plane face 40 via orifices 44 each of which is suitable for coming into communication successively with each of the orifices 43 of the cylinder ducts 42 during rotation of the cylinder block 6 relative to the assembly comprising the distributor valve 10, the casing 1*a*, 1*b*, 1*c*, and the cam 12; these distribution ducts comprise first distribution ducts 45*a* corresponding to the first slopes 12*a* of the first group of undulations, second distribution ducts 45*d* corresponding to the second slopes 12*d* of the first group of undulations, first distribution ducts 45*c* corresponding to the first slopes 12*c* of the second group of undulations, and second distribution ducts 45*b* corresponding to the second slopes 12*b* of the second group of undulations;

the distribution ducts are in permanent communication with corresponding ones of the distribution manifolds as follows: the first distribution ducts 45*a* corresponding to the first group of undulations are in communication with the first distribution manifold 21, the second distribution ducts 45*d* corresponding to the first group of undulations are in communication with the third distribution manifold 23, the first distribution ducts 45*c* corresponding to the second group of undulations are in communication with the second distribution manifold 22, and the second distribution ducts 45*b* corresponding to the second group of undulations are in communication with the third distribution manifold 23, which manifold is thus in communication with both sets of second distribution ducts;

the first transit chamber 24 corresponding to the first cylinder-capacity selection slide valve 17 and the first transit chamber 27 corresponding to the second cylinder-capacity selection slide valve 18 are in permanent communication with a duct 46 via a first external connector 47;

the third transit chamber 26 corresponding to the first cylinder-capacity selection slide valve 17 and the third transit chamber 29 corresponding to the second cylinder-capacity selection slide valve 18 are in permanent communication with a duct 48 via a second external connector 49;

the second transit chamber 25 corresponding to the first cylinder-capacity selection slide valve 17 and the second distribution manifold 22 are in permanent communication via a passage 50 provided through casing portion 1*c;* the second transit chamber 28 corresponding to the second cylinder-capacity selection slide valve 18 and the first distribution manifold 21 are in permanent communication via a passage 51 provided through casing portion 1*c*; and the cylinder-capacity selection slide valves also provide the following connections:

when in its first position (FIGS. 1 and 7, with the spring 32 having the predominant effect), the first cylinder-capacity selection slide valve 17 puts its first and second transit chambers 24 and 25 into communication via its communication chamber 30;

when in its second position (FIGS. 6 and 8, with the control fluid contained in the control chamber 34 having the predominant action), the first cylinder-capacity selection slide valve 17 puts its second and third transit chambers 25 and 26 into communication via its communication chamber 30;

when in its first position (FIGS. 1 and 6, with the spring 33 having the predominant effect), the second cylinder-capacity selection slide valve 18 puts its first and second transit chambers 27 and 28 into communication via its communication chamber 31; and when in its second position (FIGS. 7 and 8, with the control fluid contained in the control chamber 35 having the predominant effect), the second cylinder-capacity selection slide valve 18 puts its second and third transit chambers 28 and 29 into communication via its communication chamber 31.

Figure 9:
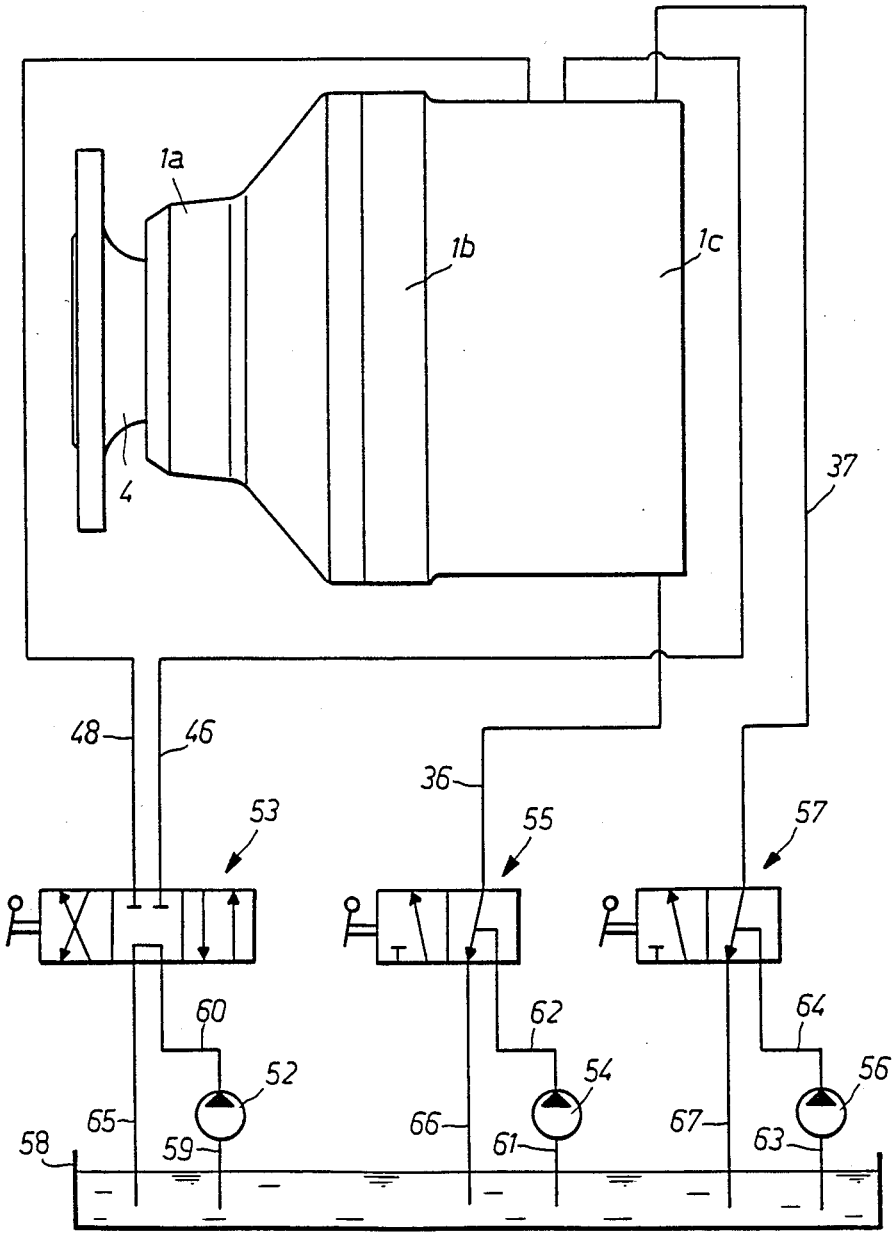
FIG. 9 is a diagram of a circuit for controlling the motor of FIGS. 1 to 8.

FIG. 9 shows the control and fluid feed circuit for the above-described motor. This circuit comprises:

a main pump 52;

a three-position main fluid distributor valve 53;

a first control pump 54;

a two-position first control distributor valve 55;

a second control pump 56;

a two-position second control distributor valve 57; and a hydraulic fluid tank 58.

The following ducts interconnect these various components:

an inlet duct 59 connects the main pump 52 to the tank 58;

an outlet duct 60 connects the main pump 52 to the main distributor valve 53;

an inlet duct 61 connects the first control pump 54 to the tank 58;

an outlet duct 62 connects the first control pump 54 to the first control distributor valve 55;

an inlet duct 63 connects the second control pump 56 to the tank 58;

an outlet duct 64 connects the second control pump 56 to the second control distributor valve 57;

exhaust ducts 65, 66, and 67 respectively connect the main distributor valve 53 and the first and second control distributor valves 55 and 57 to the tank 58;

the ducts 46 and 48 are connected to the main distributor valve 53; and the ducts 36 and 37 are respectively connected to the first and second control distributor valves 55 and 57.

The three positions of the main distributor valve 53 provide the following functions:

in its first position, the ducts 60 and 46 are put into communication as are the ducts 48 and 65;

in its second position, both ducts 46 and 48 are closed and the ducts 60 and 65 are put into communication with each other; and in its third position, the ducts 60 and 48 are put into communication as are the ducts 46 and 65.

The two positions of the first control distributor valve 55 provide the following functions:

in its first position the ducts 36, 62, and 66 are put into communication with one another; and in its second position the ducts 62 and 36 are put into communication, while the duct 66 is closed.

The two positions of the second control distributor valve 57 provide the following functions:

in its first position, the ducts 36, 64, and 67 are put into communication with one another; and in its second position, the ducts 64 and 37 are put into communication, while the duct 67 is closed.

In the embodiment shown, all of the pistons 14 have the same diameter such that the volume of fluid displaced by a piston is proportional to the stroke of the piston along one of the undulations, and the same coefficient of proportionality (equal to the sectional area of the piston) applies to all of the undulations. In addition, any one of the undulations 12*a*–12*d* provides a piston that runs therealong with a go-and-return stroke C1, whereas any one of the undulations 12c–12b provides a piston which runs therealong with a go-and-return stroke C2 which is different from C1.

It has also been stated that there are the same number of 12a–12d type undulations (three) as there are 12c–12b type undulations (three), such that the cylinder capacities of the motor (which corresponds to one complete revolution of the outlet shaft 4) that may be put into operation are directly proportional with the same coefficient of proportionality to the strokes C1 and C2, i.e. kC1 and kC2.

The following effective cylinder capacities can thus be obtained, with the main distributor valve 53 being in its first position:

when the first and second cylinder-capacity selection slide valves 17 and 18 are both in their respective first positions (FIG. 1), the ducts 45a and 45c contain the fluid under pressure delivered by the main pump 52, the ducts 45b and 45d are in communication with the tank 58 via the ducts 48 and 65, and the slopes 12a and 12c both correspond to piston-driving strokes so that the apparent cylinder capacity is CY1=k(C1+C2);

with the first cylinder-capacity selection slide valve 17 in its second position and the second cylinder-capacity selection slide valve 18 in its first position (FIG. 6), only the ducts 45a contain fluid under pressure as delivered by the main pump 52, while the ducts 45c (and also the ducts 45b and 45d) are in communication with the tank 58, and only the slopes 12a correspond to piston-driving strokes, such that the apparent cylinder capacity is CY2=kC1;

with the first cylinder-capacity selection slide valve 17 in its first position and the second cylinder-capacity selection slide valve 18 in its second position (FIG. 7), only the ducts 45c contain fluid under pressure as delivered by the main pump 52, while the ducts 45a (and also the ducts 45b and 45d) are in communication with the tank 58, and only the slopes 12c correspond to piston-driving strokes, giving an apparent cylinder capacity of CY3=kC2; and finally, when both cylinder-capacity selection slide valves 17 and 18 are in their respective second positions (FIG. 8) there is no longer any drive stroke, and the apparent cylinder capacity is CY4=0.

As a result, it is possible to obtain three different apparent cylinder capacity CY1, CY2, and CY3 which are all different from zero and which correspond respectively to three different speeds V1, V2, and V3 of the motor shaft 4.

This result is obtained very simply using two slide valves 17 and 18 which are simple (i.e. they are cylindrical and each of them has one annular groove only) and which are also identical, thereby considerably reducing manufacturing costs.

It should be observed that since the slide valves 17 and 18 each has only one communication chamber (or annular groove) 30 or 31, and since each of the bores 19 and 20 has only three transit chambers 24, 25, 26 or 27, 28, 29, the overall axial length of each slide and the bore in which it is received is relatively small, and in particular is not greater than the length which is required for installing the distributor valve 10. As a result there is no increase in the length of the motor.

It should be observed that although it is considered best and preferable in the embodiment shown to have only one distribution manifold 23 for returning to the tank the fluid which escapes from the working chambers 41 of the cylinders via distribution ducts 45b and 45d, it is also possible to provide two such manifolds 23 and to connect the distribution ducts 45d to the first one of these "exhaust" manifolds and to connect to the distribution ducts 45d to the second one of these "exhaust" manifolds which is different from the first. Such a variant is specifically envisaged in the present patent application.

Further, in the embodiment shown, the choice has been made to put the first distribution ducts 45a and/or 45c into communication with the non-pressurized exhaust 58. If the strokes of a piston are to be neutralized relative to some of the undulations 12a–12d or 12c–12b,it is appropriate to ensure that the pressure in the first ducts is equal to the pressure in the corresponding second ducts. If these pressures were different, then said neutralization of some of the strokes of a piston would only be partial, thereby providing a possible design, albeit one which is a priori complicated. Another possible way within the scope of the invention for neutralizing some of the piston strokes other than by selectively isolating the first distribution ducts 45a and/or 45c for supplying fluid under pressure from the main pump 52, would be to selectively isolate the second distribution ducts 45d and/or 45b leading to the non-pressurized exhaust (tank 58), for example by putting the second distribution ducts into communication with the pressurized fluid feed. All of these variant embodiments come within the scope of the present invention.

Another variant within the scope of the invention consists in designing the slide valves 17 and 18 as rotary fluid distributor valves analogous to that shown in French patent No. 1 572 390.

The invention is not limited to the embodiment described above but covers any variant which may be applied thereto while remaining within the scope of the claims.

We claim:

1. A pressurized fluid (motor or pump) mechanism, e.g. a hydraulic motor having at least two selectable distinct non-zero cylinder capacities, the mechanisms being constituted by:

at least one first external connector for connection to a source of fluid under pressure, and at least one second external connector for connection to a fluid exhaust;

at least one cam whose profile corresponds to a plurality of successive undulations, said undulations being divided at least into first and second distinct groups of undulations with each undulation comprising a first slope and a second slope;

a cylinder block mounted to rotate relative to said cam about an axis of rotation and which includes a plurality of cylinders disposed substantially radially relative to said axis of rotation;

each cylinder having at least one piston slidably mounted therein and suitable for bearing against the cam and delimiting, within said cylinder, a working chamber which is connected to a communication face of the cylinder block;

a plurality of cylinder ducts each connecting one of the working chambers to said communication face of the cylinder block;

a fluid distribution face constrained to rotate with the cam, said face permanently bearing against the communication face of the cylinder block and having first and second fluid distribution ducts opening out therein and corresponding to said first and second slopes of each of the undulations, said distribution ducts being suitable for being put into communication, during relative rotation of the cylinder block and the cam, with the cylinder ducts of the various cylinders;

a first cylinder-capacity selection slide valve disposed between said first and second external connectors and the first and/or second distribution ducts corresponding to the undulations of the second group of undulations;

a second cylinder-capacity selection slide valve disposed between said first and second external connectors and the first and/or second distribution ducts corresponding to the undulations of the first group of undulations;

each of said first and second cylinder-capacity selection slide valves having two particular positions, which together correspond: (A) with the first cylinder-capacity selection slide valve and the second cylinder-capacity selection slide valve both being in their respective first positions, (a) to the first distribution ducts corresponding to the undulations of both groups of undulations being put into communication with the first external connector, and (b) to the second distribution ducts corresponding to the undulations in both groups of undulations being put into communication with the second external connector; (B) with the first cylinder-capacity selection slide valve being in its second position and the first cylinder-capacity selection slide valve being in its first position, (a) to the first distribution ducts corresponding to the undulations of the first group of undulations being put into communication with the first external connector, (b) to the second distribution ducts corresponding to the undulations of said first group of undulations being put into communication with the second external connector, and (c) to the first distribution ducts corresponding to the undulations of the second group of undulations being permanently isolated from the first external connector and/or to the second distribution ducts corresponding to the undulations of said second group of undulations being permanently isolated from the second external connector; (C) with the first cylinder-capacity selection slide valve in its first position and the second cylinder-capacity selection slide valve being in its second position, (a) to the first distribution ducts corresponding to the undulations of the second group of undulations being put into communication with the first external connector, (b) to the second distribution ducts corresponding to the undulations of the second group of undulations being put into communication with the second external connector, and (c) to the first distribution ducts corresponding to the undulations of the first group of undulations being permanently isolated from the first external connector and/or to the second distribution ducts corresponding to undulations of the first group of undulations being permanently isolated from the second external connector; and (D) with the first cylinder-capacity selection slide valve in its second position and the second cylinder-capacity selection slide valve in its second position, to the first distribution ducts corresponding to undulations of the first group of undulations being permanently isolated from the first external connector and to the second distribution ducts corresponding to the undulations of the second group of undulations being permanently isolated from the second external connector and/or to the second distribution ducts corresponding to the undulations of the first group of undulations being permanently isolated from the second external connector and to the first distribution ducts corresponding to the undulations to the second group of undulations being permanently isolated from the first external connector, and/or to the first distribution ducts corresponding to the undulations of both groups of undulations being permanently isolated from the first external connector, and/or to the second distribution ducts corresponding to the undulations of both groups of undulations being permanently isolated from the second external connector.

2. A pressurized fluid (motor pump) mechanism, e.g. a hydraulic motor having at least two selectable distinct non-zero cylinder capacities, the mechanism being constituted by:

at least one first external connector for connection to a source of fluid under pressure, and at least one second external connector for connection to a fluid exhaust;

at least one cam whose profile corresponds to a plurality of successive undulations, said undulations being divided at least into first and second district groups of undulations with each undulation comprising a first slope and a second slope;

a cylinder block mounted to rotate relative to said cam about an axis of rotation and which includes a plurality of cylinders disposed substantially radially relative to said axis of rotation;

each cylinder having at least one piston slidably mounted therein and suitable for bearing against the cam and delimiting, within said cylinder, a working chamber which is connected to a communication face of the cylinder block;

a plurality of cylinder ducts each connecting one of the working chambers to said communication face of the cylinder block;

a fluid distribution face constrained to rotate with the cam, said face permanently bearing against the communication face of the cylinder block and having first and second fluid distribution ducts opening out therein and corresponding to said first and second slopes of each of the undulations, said distribution ducts being suitable for being put into communication, during relative rotation of the cylinder block and the cam, with the cylinder ducts of the various cylinders;

a first cylinder-capacity selection slide valve disposed between said first and second external connectors and the first and/or second distribution ducts corresponding to the undulations of the second group of undulations;

a second cylinder-capacity selection slide valve disposed between said first and second external connectors and the first and/or second distribution ducts corresponding to the undulations of the first group of undulations;

each of said first and second cylinder-capacity selection slide valves having two particular positions, which together correspond: (A) with the first cylinder-capacity selection slide valve and the second cylinder-capacity selection slide valve both being in their respective first positions, (a) to the first distribution ducts corresponding to the undulations of both groups of undulations being put into communication with the first external connector, and (b) to the second distribution ducts corresponding to the undulations in both groups of undulations being put into communication with the second external connector; (B) with the first cylinder-capacity selection slide valve being in its second position and the first cylinder-capacity selection slide valve being in its first positions, (a) to the first distribution ducts corresponding to the undulations of the first group of undulations being put into communication with the first external connector, (b) to the second distribution ducts corresponding to the undulations of said first group of undulations being put into communication with the second external connector, and (c) to the first distribution ducts corresponding to the undulations of the second group of undulations being permanently isolated form the first external connector and/or to the second distribution ducts corresponding to the undulations of said second group of undulations being permanently isolated from the second external connector; (C) with the first cylinder-capacity selection slide valve in its first position and the second cylinder-capacity selection slide valve being in its second position, (a) to the first distribution ducts corresponding to the undulations of the second group of undulations being put into communication with the first external connector, (b) to the second distribution ducts corresponding to the undulations of the second group of undulations being put into communication with the second external connector, and (c) to the first distribution ducts corresponding to the undulations of the first group of undulations being permanently isolated from the first external connector and/or to the second distribution ducts corresponding to undulations of the first group of undulations being permanently isolated from the second external connector; and (D) with the first cylinder-capacity selection slide valve in its second position and the second cylinder-capacity selection slide valve in its second position, to the first distribution ducts corresponding to undulations of the first group of undulations being permanently isolated from the first external connector and to the second distribution ducts corresponding to the undulations of the second group of undulations being permanently isolated from the second external connector and/or to the second distribution ducts corresponding to the undulations of the first group of undulations being permanently isolated from the second external connector and to the first distribution ducts corresponding to the undulations to the second group of undulations being permanently isolated from the first external connector, and/or to the first distribution ducts corresponding to the undulations of both groups of undulations being permanently isolated from the first external connector, and/or to the second distribution ducts corresponding to the undulations of both groups of undulations being permanently isolated from the second external connector and wherein the cam is an integral part of a housing which itself constitutes the slide valve body in which the bores of the first and second cylinder-capacity selection slide valves are formed.

3. A mechanism according to claim 2, wherein:

(a) three distinct distribution manifolds are provided linked to the cam, with the first distribution ducts corresponding to the undulations of the first group of undulations opening out into a first one of said distribution manifolds, with the first distribution ducts corresponding to the undulations of the second group of undulations opening out into a second of said distribution manifolds, and with the second distribution ducts corresponding to the undulations of both the first and the second groups of undulations opening out into the third of said distribution manifolds;

(b) each of the first and second cylinder-capacity selection slide valves is movably mounted in a corresponding bore provided in a valve body with each bore having a corresponding first, second, and a third transit chambers provided in said body and opening out into said bore;

(c) each slide valve slide member has a communication chamber formed therein and opening out peripherally;

(d) the following permanent connections are provided:

the first transit chamber of each slide valve is connected to the first external connector;

the second transit chamber of the first slide valve is connected to the second distribution manifold;

the second transit chamber of the second slide valve is connected to the first distribution manifold; and the third transit chambers of both slide valves are connected to the second distribution manifold and to the second external connector; and (e) the following connections are provided in the first and/or second positions of each of the cylinder-capacity selection slide valves:

in the first position of the first slide valve, the first and second transit chambers of said first slide valve are put into communication via the communication chamber of said first slide valve;

in the second position of the first slide valve, the second and third transit chambers of said first slide valve are put into communication via the communication chamber of said first slide valve;

in the first position of said second slide valve, the first and second transit chambers of said second slide valve are put into communication via the communication chamber of said second slide valve; and in the second position of the second slide valve, the second and third transit chambers of the second slide valve are put into communication via the communication chamber of said second slide valve.

4. A mechanism according to claim 2, wherein the second cylinder-capacity selection slide valve is identical to the first cylinder-capacity selection slide valve.

5. A mechanism according to claim 2, wherein each slide valve is mounted to slide in translation within the corresponding bore.

6. A mechanism according to claim 6, wherein each bore comprises at least one end and provides a chamber between said end and one of the ends of the corresponding slide of the cylinder-capacity selection slide valve, said chambers receiving fluid under pressure to adjust the position of said cylinder-capacity selection slide valve.

7. A mechanism according to claim 2, wherein the cam has an even number of undulations, with the undulations of the first group of undulations each having a first amplitude which corresponds to a first stroke of a piston bearing against said undulation during relative rotation between the cylinder block and the cam, and with the undulations of the second group of undulations each having a second amplitude corresponding to a second stroke of a piston bearing against said second undulation during relative rotation of the cylinder block relative to the cam, with said first and second strokes having different values, and with the various undulations following one another in such a manner that each of the undulations of the second group of undulations lies between two undulations of the first group of undulations.

8. A pressurized fluid (motor or pump) mechanism, e.g. a hydraulic motor having at least two selectable distinct non-zero cylinder capacities, the mechanism being constituted by:

at least one first external connector for connection to a source of fluid under pressure, and at least one second external connector for connection to a fluid exhaust;

at least one cam whose profile corresponds to a plurality of successive undulations, said undulations being divided at least into first and second distinct groups of undulations with each undulation comprising a first slope and a second slope;

a cylinder block mounted to rotate relative to said cam about an axis of rotation and which includes a plurality of cylinders disposed substantially radially relative to said axis of rotation;

each cylinder having at least one piston slidably mounted therein and suitable for bearing against the cam and delimiting, within said cylinder, a working chamber which is connected to a communication face of the cylinder block;

a plurality of cylinder ducts each connecting one of the working chambers to said communication face of the cylinder block;

a fluid distribution face constrained to rotate with the cam, said face permanently bearing against the communication face of the cylinder block and having first and second fluid distribution ducts opening out therein and corresponding to said first and second slopes of each of the undulations, said distribution ducts being suitable for being put into communication, during relative rotation of the cylinder block and the cam, with the cylinder ducts of the various cylinders; and cylinder capacity selection means comprising at least a first cylinder-capacity selection slide valve disposed between said first and second external connectors and the first and/or second distribution ducts corresponding to the undulations of the second group of undulations; said first cylinder capacity selection slide valve having a first position suitable for corresponding: (a) to the first distribution ducts corresponding to the undulations of the first group of undulations being put into communication with first external connector, (b) to the second distribution ducts corresponding to the undulations of said first group of undulations being put into communication with the second external connector, and (c) to the first distribution ducts corresponding to the undulations of the second group of undulations being permanently isolated from the first external connector and/or to the second distribution ducts corresponding to the undulations of the second group of undulations being permanently isolated from the second external connector;

wherein said cylinder capacity selection means further includes a second cylinder-capacity selection slide valve which also has two positions and which is disposed between the first and second external connectors and the first and/or second distribution ducts corresponding to the undulations of the first group of undulations, said second cylinder-capacity selection slide valve having a first position which corresponds (a) to the first distribution ducts corresponding to the undulations of the first group of undulations being put into communication with first external connector, (b) to the second distribution ducts corresponding to the undulations of said first group of undulations being put into communication with the second external connector, and having a second position which corresponds to the first distribution ducts corresponding to the undulations of the first group of undulations being permanently isolated from the first external connector and/or to the second distribution ducts corresponding to the undulations of said first group of undulations being permanently isolated from the second external connector.

9. A pressurized fluid (motor or pump) mechanism, e.g. a hydraulic motor having at least two selectable distinct non-zero cylinder capacities, the mechanism being constituted by:

at least one first external connector for connection to a source of fluid under pressure, and at least one second external connector for connection to a fluid exhaust;

at least one cam whose profile corresponds to a plurality of successive undulations, said undulations being divided at least into first and second distinct groups of undulations with each undulation comprising a first slope and a second slope;

a cylinder block mounted to rotate relative to said cam about an axis of rotation and which includes a plurality of cylinders disposed substantially radially relative to said axis of rotation;

each cylinder having at least one piston slidably mounted therein and suitable for bearing against the cam and delimiting, within said cylinder, a working chamber which is connected to a communication face of the cylinder block;

a plurality of cylinder ducts each connecting one of the working chambers to said communication face of the cylinder block;

a fluid distribution face constrained to rotate with the cam, said face permanently bearing against the communication face of the cylinder block and having first and second fluid distribution ducts opening out therein and corresponding to said first and second slopes of each of the undulations, said distribution ducts being suitable for being put into communication, during relative rotation of the cylinder block and the cam, with the cylinder ducts of the various cylinders; and cylinder capacity selection means comprising at least a first cylinder-capacity selection slide valve disposed between said first and second external connectors and the first and/or second distribution ducts corresponding to the undulations of the second group of undulations; said first cylinder capacity selection slide valve having a first position suitable for corresponding: (a) to the first distribution ducts corresponding to the undulations of the first group of undulations being put into communication with first external connector, (b) to the second distribution ducts corresponding to the undulations of said first group of undulations being put into communication with the second external connector, and (c) to the first distribution ducts corresponding to the undulations of the second group of undulations being permanently isolated from the first external connector and/or to the second distribution ducts corresponding to the undulations of the second group of undulations being permanently isolated from the second external connector;

wherein said cylinder capacity selection means further includes a second cylinder-capacity selection slide valve which also has two positions and which is disposed between the first and second external connectors and the first and/or second distribution ducts corresponding to the undulations of the first group of undulations said second cylinder-capacity selection slide valve having a first position which corresponds (a) to the first distribution ducts corresponding to the undulations of the first group of undulations being put into communication with first external connector, (b) to the second distribution ducts corresponding to the undulations of said first group of undulations being put into communication with the second external connector, and having a second position which corresponds to the first distribution ducts corresponding to the undulations of the first group of undulations being permanently isolated from the first external connector and/or to the second distribution ducts corresponding to the undulations of said first group of undulations being permanently isolated from the second external connector and wherein the cam is an integral part of a housing which itself constitutes the slide valve body in which the bores of the first and second cylinder-capacity selection slide valves are formed.

10. A mechanism according to claim 9, wherein: (a) three distinct distribution manifolds are provided linked to the cam, with the first distribution ducts corresponding to the undulations of the first group of undulations opening out into a first one of said distribution manifolds, with the first distribution ducts corresponding to the undulations of the second group of undulations opening out into a second of said distribution manifolds, and with the second distribution ducts corresponding to the undulations of both the first and the second groups of undulations opening out into the third of said distribution manifolds (b) each of the first and second cylinder-capacity selection slide valves is movably mounted into a corresponding bore provided in a valve body with each bore having a corresponding first, second and a third transmit chambers provided in said body and opening out into said bore;

(c) each slide valve slide member has a communication chamber formed therein and opening out peripherally;

(d) the following permanent connections are provided:

the first transit chamber of each slide valve is connected to the first external connector;

the second transit chamber of the first slide valve is connected to the second distribution manifold;

the second transit chamber of the second slide valve is connected to the first distribution manifold; and the third transit chambers of both slide valves are connected to the second distribution manifold and to the second external connector; and (e) the following connections are provided in the first and/or second positions of each of the cylinder-capacity selection slide valves;

in the first position of the first slide valve, the first and second transit chambers of said first slide valve are put into communication via the communication chamber of said first slide valve;

in the second position of the first slide valve, the second and third transit chambers of said first slide valve are put into communication via the communication chamber of said first slide valve;

in the first position of said second slide valve, the first and second transit chambers of said second slide valve are put into communication via the communication chamber of said second slide valve; and in the second position of the second slide valve, the second third transit chambers of the second slide valve are put into communication via the communication chamber of said second slide valve.

11. A mechanism according to claim 9, wherein the second cylinder-capacity selection slide valve is identical to the first cylinder-capacity selection slide valve.

12. A mechanism according to claim 9, wherein each slide valve is mounted to slide in translation within the corresponding bore.

13. A mechanism according to claim 12, wherein each bore comprises at least one end and provides a chamber between said end and one of the ends of the corresponding slide of the cylinder-capacity selection slide valve, said chambers receiving fluid under pressure to adjust the position of said cylinder-capacity selection slide valve.

14. A mechanism according to claim 9, wherein the cam has an even number of undulations, with the undulations of the first group of undulations each having a first amplitude which corresponds to a first stroke of a piston bearing against said undulation during relative rotation between the cylinder block and the cam, and with the undulations of the second group of undulations each having a second amplitude corresponding to a second stroke of a piston bearing against said second undulation during relative rotation of the cylinder block relative to the cam, with said first and second strokes having different values, and with the various undulations following one another in such a manner that each of the undulations of the second group of undulations lies between two undulations of the first group of undulations.

* * * * *